US009709017B2

(12) United States Patent
Hashimoto et al.

(10) Patent No.: US 9,709,017 B2
(45) Date of Patent: Jul. 18, 2017

(54) IGNITION DEVICE OF SPARK-IGNITION INTERNAL COMBUSTION ENGINE

(71) Applicant: Mitsubishi Electric Corporation, Chiyoda-ku (JP)

(72) Inventors: Takashi Hashimoto, Tokyo (JP); Tomokazu Sakashita, Tokyo (JP); Takayoshi Nagai, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 86 days.

(21) Appl. No.: 14/894,139

(22) PCT Filed: May 30, 2014

(86) PCT No.: PCT/JP2014/064440
§ 371 (c)(1),
(2) Date: Nov. 25, 2015

(87) PCT Pub. No.: WO2014/196469
PCT Pub. Date: Dec. 11, 2014

(65) Prior Publication Data

US 2016/0102647 A1 Apr. 14, 2016

(30) Foreign Application Priority Data

Jun. 4, 2013 (JP) ..... 2013-118059

(51) Int. Cl.
*F02P 7/077* (2006.01)
*F02P 3/08* (2006.01)
(Continued)

(52) U.S. Cl.
CPC ..... *F02P 7/077* (2013.01); *F02P 3/0876* (2013.01); *F02P 9/002* (2013.01); *H01T 15/00* (2013.01)

(58) Field of Classification Search
CPC ..... F02P 7/077; F02P 3/0002; F02P 3/0435; F02P 3/0807; F02P 3/0838; F02P 3/0876;
(Continued)

(56) References Cited

U.S. PATENT DOCUMENTS 5,754,011 A * 5/1998 Frus ..... F02P 3/0869 315/209 SC
5,777,867 A 7/1998 Hongu et al.
(Continued)

FOREIGN PATENT DOCUMENTS

JP 2-149771 A 6/1990
JP 05-159895 A 6/1993
(Continued)

OTHER PUBLICATIONS

Office Action issued on Apr. 12, 2016 in Japanese Patent Application No. 2015-521427 with partial English translation.
(Continued)

*Primary Examiner* — Stephen K Cronin
*Assistant Examiner* — George Jin
(74) *Attorney, Agent, or Firm* — Oblon, McClelland, Maier & Neustadt, L.L.P.

(57) ABSTRACT

In an ignition device of a spark-ignition internal combustion engine that performs ignition with high energy efficiency while reducing power to be input to a spark plug, after a DC-voltage-pulse generation circuit that generates a DC voltage pulse between electrodes of a spark plug is operated by a control circuit, an AC-pulse generation circuit that generates an AC pulse between the electrodes of the spark plug is operated. Furthermore, the control circuit controls the AC-pulse generation circuit with a plurality of group pulses and quiescent periods between the group pulses are provided.

15 Claims, 6 Drawing Sheets

(51) Int. Cl.
*H01T 15/00* (2006.01)
*F02P 9/00* (2006.01)

(58) Field of Classification Search
CPC ..... F02P 9/002; F02P 9/007; F02P 23/045; H01T 15/00
See application file for complete search history.

(56) References Cited

U.S. PATENT DOCUMENTS

| | | | | |
|---|---|---|---|---|
| 8,552,651 | B2 * | 10/2013 | Sugino | H05H 1/46 315/111.41 |
| 2008/0276905 | A1 * | 11/2008 | Czimmek | F02P 3/0838 123/406.57 |
| 2013/0214689 | A1 * | 8/2013 | Katsuraya | F02P 9/007 315/174 |

FOREIGN PATENT DOCUMENTS

| | | | |
|---|---|---|---|
| JP | 9-172788 | A | 6/1997 |
| JP | 2009-061567 | A | 3/2009 |
| JP | 2012-112310 | A | 6/2012 |
| JP | 2012-127286 | A | 7/2012 |
| JP | 2013-004433 | A | 1/2013 |
| JP | 2013-040582 | A | 2/2013 |
| JP | 2013-060941 | A | 4/2013 |

OTHER PUBLICATIONS

International Search Report Issued Aug. 12, 2014, for PCT/JP14/064440 Filed May 30, 2014.
Combined Office Action and Search Report issued on Sep. 1, 2016 in Chinese Patent Application No. 201480031541.9 with partial English translation and English translation of category of cited documents.

* cited by examiner

IGNITION DEVICE OF SPARK-IGNITION INTERNAL COMBUSTION ENGINE

FIELD

The present invention relates to an ignition device of a spark-ignition internal combustion engine that performs ignition by inducing discharge between electrodes of a spark plug.

BACKGROUND

An ignition device of a spark-ignition internal combustion engine is a device that generates discharge at a gap between electrodes of a spark plug to ignite fuel in an internal combustion engine.

A conventional ignition device performs ignition by generating spark discharge between electrodes of a spark plug with DC power generated by a DC power source, and then generating AC plasma between the electrodes of the spark plug with AC power generated by an AC power source. The conventional ignition device is characterized in that the AC power is reduced after AC plasma is generated between the electrodes. According to this conventional ignition device, it is possible to reduce the total energy supplied to electrodes by AC power for generating and maintaining AC plasma (see, for example, Patent Literature 1).

CITATION LIST

Patent Literature

Patent Literature 1: Japanese Patent Application Laid-open No. 2012-112310

SUMMARY

Technical Problem

However, the discharge environment in an engine easily changes, and thus the discharge condition therein easily changes. Therefore, the maintainable power range in which discharge can be maintained fluctuates. Thus, when the total input power is reduced as disclosed in the above conventional technique, the discharge condition becomes unstable. Once discharge dissipates, it is difficult to resume the discharge, so that, in order to avoid the risk of dissipation of discharge, excessive power is supplied to a spark plug. This causes a problem in that energy efficiency for ignition is degraded.

The present invention has been achieved in view of the above problems, and an object of the present invention is to provide an ignition device of a spark-ignition internal combustion engine that performs ignition with high energy efficiency while reducing input power.

Solution to Problem

An ignition device of a spark-ignition internal combustion engine according to the present invention includes a DC-voltage-pulse generation circuit that generates a DC voltage pulse between electrodes of a spark plug positioned in an internal combustion engine, an AC-pulse generation circuit that generates an AC pulse between the electrodes of the spark plug, and a control circuit that causes the AC-pulse generation circuit to operate after causing the DC-voltage-pulse generation circuit to operate. The control circuit controls the AC-pulse generation circuit with a plurality of group pulses, and a quiescent period is provided between the group pulses.

Advantageous Effects of Invention

An AC-pulse generation circuit is controlled by a plurality of group pulses and a quiescent period is provided between each of the group pluses. Accordingly, ignition can be performed with high energy efficiency while excessive power supply to a spark plug is reduced.

DESCRIPTION OF EMBODIMENTS

Exemplary embodiments of an ignition device of a spark-ignition internal combustion engine according to the present invention will be explained below in detail with reference to the accompanying drawings. In the descriptions of the embodiments and respective drawings, parts denoted by the same reference signs represent same or corresponding parts.

First Embodiment

Figure 1:
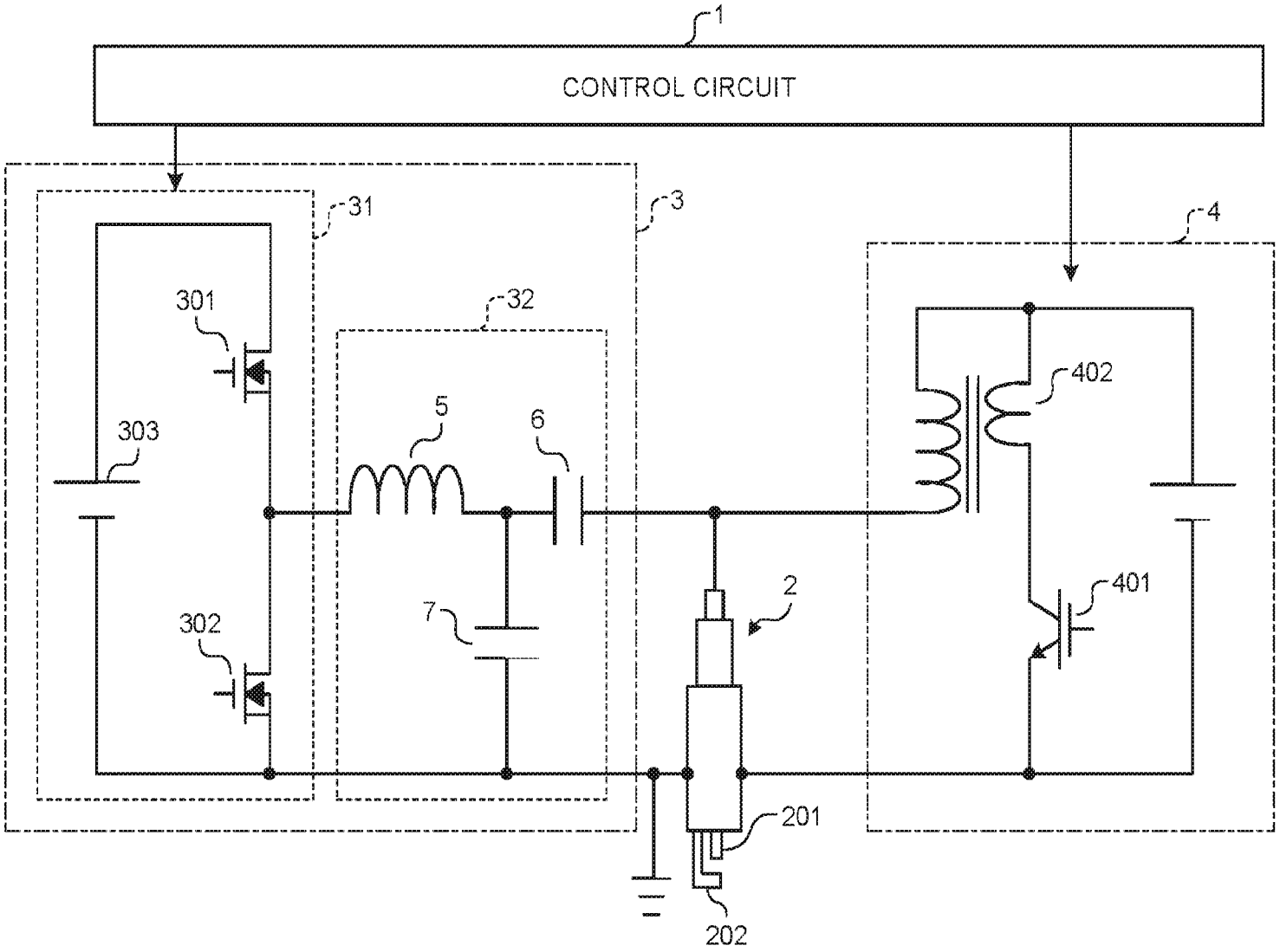
FIG. 1 is a diagram schematically illustrating a main configuration of an ignition device of a spark-ignition internal combustion engine according to a first embodiment of the present invention.

FIG. 1 schematically illustrates a main configuration of an ignition device of a spark-ignition internal combustion engine according to a first embodiment of the present invention. The ignition device according to the first embodiment of the present invention is a device that includes an AC-pulse generation circuit 3, a DC-voltage-pulse generation circuit 4, and a control circuit 1, and generates plasma between a center electrode 201 and a ground electrode 202 in a spark plug 2 to ignite fuel of an internal combustion engine (not illustrated). The ground electrode 202 is grounded through a structure of an internal combustion engine to which the ignition device is attached. The AC-pulse generation circuit 3 includes a switching unit 31 and a resonance unit 32. Upon reception of an ON/OFF timing signal as a control signal from the control circuit 1, driving of the AC-pulse generation circuit 3 and the DC-voltage-pulse generation circuit 4 is controlled. The ground electrode 202 is connected to the ground side of the AC-pulse generation circuit 3 and the DC-voltage-pulse generation circuit 4.

The switching unit 31 includes switching elements 301 and 302 and a DC power source 303. The output power of the DC power source 303 is assumed to be 200 volts. The switching unit 31 is connected to the spark plug 2 through the resonance unit 32. In the first embodiment, FETs (Field Effect Transistors) are used as the switching elements 301 and 302. Alternatively, switching elements such as IGBTs (Insulated Gate Bipolar Transistors) can be used. Upon reception of a timing signal for turning ON/OFF the switching elements 301 and 302 as a control signal, driving of the switching unit 31 is controlled.

The resonance unit 32 includes a reactor 5, a serial capacitor 6, and a resonance capacitor 7. The serial capacitor 6 is connected to the spark plug 2 in series. The resonance capacitor 7 is connected in parallel with the serial synthetic capacitance of the serial capacitor 6 and the spark plug 2. The serial capacitor 6 and the resonance capacitor 7 are connected to the center electrode 201 and the ground electrode 202, respectively. The synthetic capacitance of the serial capacitor 6, the spark plug 2 and the resonance capacitor 7, and the reactor 5 form a serial resonance circuit.

In the first embodiment, the AC-pulse generation circuit 3 uses a half bridge circuit in which two switching elements are used for the switching unit 31. The AC-pulse generation circuit 3 includes the switching unit 31 and the resonance unit 32. The AC-pulse generation circuit 3 supplies high-frequency power to the spark plug 2. Alternatively, the AC-pulse generation circuit 3 can be configured by a full bridge circuit including four switching elements, instead of a half bridge circuit. The AC-pulse generation circuit 3 using a half bridge circuit includes only two switching elements, and thus the circuit configuration can be simplified. Further, the AC-pulse generation circuit 3 is not limited to a half bridge circuit or a full bridge circuit as long as control signals input from the control circuit 1 to respective gates of the switching elements 301 and 302 causes ON/OFF operations of the switching elements 301 and 302 alternately to form an AC circuit. A high frequency generated by the AC-pulse generation circuit 3 is 1 to 5 megahertz, and is preferably about 2 megahertz. The output of the AC-pulse generation circuit 3 is an output obtained by making the output of the switching unit 31 resonate with the floating capacitance of the resonance unit 32 and the spark plug 2.

The DC-voltage-pulse generation circuit 4 turns ON a switching element 401 to pass a current to a primary side of an ignition coil 402 and accumulate energy. Subsequently, the switching element 401 is turned OFF to generate a high voltage of 20 to 50 kilovolts at a secondary side of the ignition coil 402. This method is generally referred to as "full transistor method". Alternatively, a CDI (Capacitor Discharge Ignition) system in which an electric charge accumulated in a capacitor is boosted by an ignition coil can be used. In the first embodiment, an IGBT is used as the switching element 401. However, it is needless to mention that a switching element such as a FET can be also used as long as a breakdown voltage can be thereby obtained.

While the resonance capacitor 7 stabilizes a resonance operation at the time of performing the resonance operation, it is not always essential. When resonance capacitors are provided in parallel, resonance can be caused with the resonance capacitors as objects, irrespective of changes in the state of a spark plug. Accordingly, stable resonance can be achieved without depending on load fluctuation. However, large power is required because a resonance current always flows to the capacitors. For example, when the value of the reactor 5 is set to 30 μH and it is estimated that the resonance capacitor 7 is 200 pF, the serial capacitor 6 is 50 pF, and the floating capacitance of the spark plug 2 is 15 pF, the resonance frequency when the spark plug 2 is in an open state and no discharge is performed can be estimated at 2 megahertz. When it is considered that the center electrode 201 and the ground electrode 202 are conducted during the discharge, the resonance frequency of 1.84 megahertz can be obtained with the fixed values described above.

The output pulse of the DC-voltage-pulse generation circuit 4 is of a high voltage of several tens of kilovolts. The output of the AC-pulse generation circuit 3 is a large current having a current peak of about 3 to 8 amperes. In the first embodiment, frequency separation is used as a method of combining outputs of the two circuits. That is, as the resonance unit 32 is used for the output of the AC-pulse generation circuit 3, electric power near the resonance frequency can enter the spark plug 2 from the AC-pulse generation circuit 3. On the other hand, because the output of the DC-voltage-pulse generation circuit 4 is deviated from the resonance frequency, the output does not enter the AC-pulse generation circuit 3.

Figure 2:
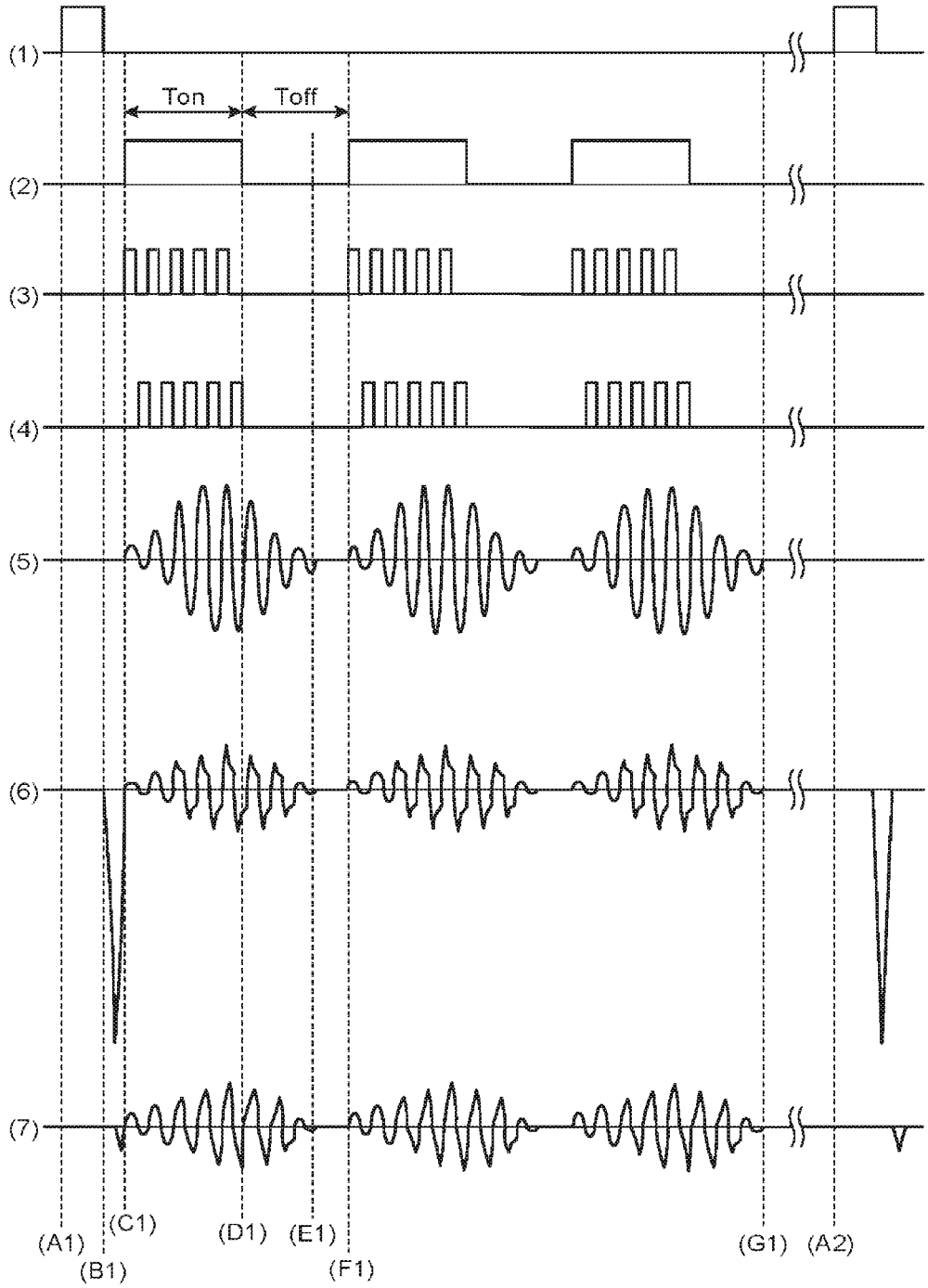
FIG. 2 is an explanatory diagram of operations of the ignition device of a spark-ignition internal combustion engine according to the first embodiment of the present invention.

FIG. 2 is an explanatory diagram of operations of the control circuit 1, the AC-pulse generation circuit 3, and the DC-voltage-pulse generation circuit 4 of the ignition device according to the first embodiment. In FIG. 2, the horizontal axes indicate time. In FIG. 2, (1) indicates a control signal for the control circuit 1 to control the switching element 401 of the DC-voltage-pulse generation circuit 4, (2) indicates a group-pulse generating signal for the control circuit 1 to generate a group pulse for operating the switching unit 31 of the AC-pulse generation circuit 3, and ON/OFF operations of the switching elements 301 and 302 are performed by a frequency specified while the signal (2) is ON. In FIG. 2, (3) indicates a control signal for the control circuit 1 to cause an ON/OFF operation of the switching element 301, and (4) indicates a control signal for the control circuit 1 to cause an ON/OFF operation of the switching element 302. That is, the control signals (3) and (4) are applied to the gates of the switching elements 301 and 302, respectively. Pulse trains of the signals (3) and (4) are referred to as "group pulses". Each of the control signals (3) and (4) has a plurality of group pulses. (5) indicates an output of the resonance unit 32, and indicates a waveform of a current that flows to the reactor 5. (6) indicates a waveform of a voltage between the center electrode 201 and the ground electrode 202 of the spark plug 2. (7) indicates a waveform of a current between the center electrode 201 and the ground electrode 202 of the spark plug 2.

(A1) to (G1) and (A2) in FIG. 2 represent timings. When the switching element 401 of the DC-voltage-pulse generation circuit 4 is turned ON during a period from the timing (A1) to the timing (B1), energy is accumulated in the ignition coil 402. At the timing (B1) for turning OFF the switching element 401, a DC voltage pulse is applied to the spark plug 2 by exciting energy accumulated in the ignition coil 402, so that insulation breakdown occurs between the center electrode 201 and the ground electrode 202, which constitute electrodes of the spark plug 2. Next, at the timing (C1), the group-pulse generating signal (2) becomes ON and the control signals (3) and (4) for the switching elements 301 and 302, respectively, are turned ON/OFF alternately.

Accordingly, an AC pulse is output from the AC-pulse generation circuit 3. The group-pulse generating signal (2) is OFF at the timing (D1). It takes time of a few cycles (from the timing (D1) to the timing (E1)) to reduce the plug current (7) to zero because resonance energy remains. Therefore, a period from the timing (E1) to the timing (F1) is the period in which no power is actually input from the AC-pulse generation circuit 3 between the electrodes of the spark plug 2. During the period from the timing (E1) to the timing (F1), an atmosphere between the electrodes of the spark plug 2 is in a state where discharge is easier to be generated, as compared to the periods before the timing (B1). Accordingly, when the group-pulse generating signal (2) becomes ON again at the timing (F1), the control signals (3) and (4) resume ON/OFF operations alternately, and an AC pulse is applied to the spark plug 2 so that discharge is generated.

While the ignition device according to the first embodiment repeats intermittent operations in one ignition period (a period from the timing (A1) to the timing (A2) in FIG. 2), an AC pulse is continuously applied between the electrodes of the spark plug 2 for 1 millisecond, including the period of the intermittent operations from generation of the DC voltage pulse. While this AC application period (a period from the timing (C1) to the timing (G1) in FIG. 2) is not necessarily limited to 1 millisecond, approximately 1 millisecond is sufficient to form a flame kernel required for ignition, and application longer than approximately 1 millisecond results in inputting of excessive power.

As illustrated in FIG. 2, a period from the timing (C1) to the timing (D1) is Ton, a period from the timing (D1) to the timing (F1) is Toff, and Toff is referred to as "quiescent period". Thus, the control signal output from the control circuit 1 and input to the switching unit 31 has a plurality of group pulses, between which quiescent periods are provided. When the ignition device according to the first embodiment is used, energy input to the spark plug 2 can be reduced to Ton/(Ton+Toff) as compared to a case where no intermittent oscillation is made but a continuous oscillation operation is performed.

Ton needs to be set in consideration of forming of discharge and growth of resonance, and is preferable to be set to 30 microseconds or more, for example. Due to this setting, a current peak value that is equivalent to a current peak value for continuous oscillation control can be obtained. When the frequency is set to 2 megahertz and Ton is set to 30 microseconds, a 60-cycle pulse is applied during the Ton period. Toff needs to be set to fall within a time not adversely affecting forming of a flame kernel, and is preferably 100 microseconds or less, for example. When Ton is 50 microseconds and Toff is 50 microseconds, ten group pulses can be formed in 1 millisecond, and energy to be input can be reduced to one half of energy required for a continuous oscillation operation.

In other words, this indicates that it is sufficient if the frequency of discharge required for ignition is a low frequency, which is about 1/200 of an output frequency of a high-frequency generation circuit, and suggests that a 100-s cycle (10 kilohertz) is sufficient. A high voltage that is several tens of kilovolts and a large current that has a current peak value of about 8 amperes of the DC-voltage-pulse generation circuit 4 are separated by frequency separation (heightening an application frequency of the high-frequency generation circuit). Therefore, a discharge frequency required for ignition cannot be freely selected due to restrictions of frequencies of the two circuits. Therefore, intermittent control is used as means for obtaining an apparent low-frequency pulse as a discharge characteristic even if the apparent low-frequency pulse is a high-frequency pulse.

Energy effective for forming a flame kernel depends on the peak value of a discharge current flowing to the spark plug 2. Therefore, while earning a current peak value by performing an intermittent operation as in the first embodiment, excessive energy can be prevented from being input to the spark plug 2. Due to this configuration, heat generation from a circuit is suppressed so that an ignition device can be downsized and wear of plugs can be prevented even when the ignition device is used for a long time. The peak value of the discharge current, that is, a maximum-power inputting condition is set to a condition (a discharge starting voltage) in which discharge can be resumed without fail even in a non-discharge state. The discharge starting voltage before the timing (B1) is equal to an ignition voltage. In a period from the timing (E1) to the timing (F1), no power is input between the electrodes of the spark plug 2. However, in this period, unlike in the state before the timing (B1) (more specifically, a state before the timing of insulation breakdown caused by application of the DC voltage pulse between the electrodes of the spark plug 2), the discharge starting voltage is lower than the ignition voltage. The discharge starting voltage becomes lowest immediately after the timing (C1) and increases with a lapse of time to approach the ignition voltage. The ignition device according to the first embodiment resumes discharge in a state where the discharge starting voltage is lower than the ignition voltage. Therefore, excessive power can be prevented from being input to the spark plug 2.

When intermittent control is executed to an AC waveform, generation and stop of discharge are digitally repeated, but due to a big change in an instantaneous current, this configuration easily generates a noise source and causes ripple heat generation of an electrolytic capacitor included in the DC power source 303. In this case, when a resonance circuit is applied, a growing time and an attenuation time of resonance are generated. Accordingly, discharge can be generated and stopped not in a digital manner, but in an analog manner as illustrated in the timing (C1) and the timing (E1) of (5) and (7) in FIG. 2. Due to this configuration, a sudden change of phenomenon can be avoided and generation of an instantaneous current can be suppressed. That is, the noise source can be suppressed and ripple heat generation of the electrolytic capacitor included in the DC power source 303 can be suppressed. In this manner, in order to execute intermittent control of an AC waveform more efficiently, it is preferable to apply the circuit configuration using resonance as in the first embodiment.

Second Embodiment

Figure 3:
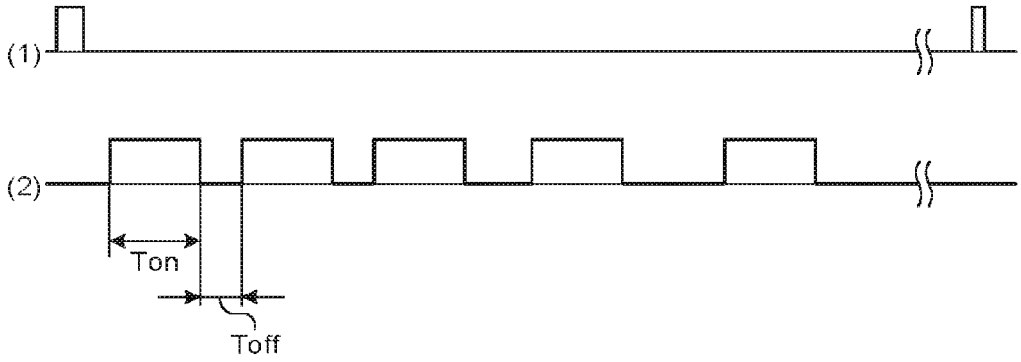
FIG. 3 is an explanatory diagram of operations of an ignition device of a spark-ignition internal combustion engine according to a second embodiment of the present invention.

FIG. 3 illustrates a part of operations of an ignition device of a spark-ignition internal combustion engine according to a second embodiment of the present invention. The circuit configuration of the ignition device according to the present embodiment can be identical to that of the first embodiment illustrated in FIG. 1. The present embodiment differs from the first embodiment in the group-pulse generating signal for generating group pulses and the control signal output from the control device 1 to control the AC-pulse generation circuit 3. FIG. 3 is a diagram illustrating control signals for driving the AC-pulse generation circuit 3 and the DC-voltage-pulse generation circuit 4 of the ignition device according to the present embodiment. In FIG. 3, signal names having the same function as that in the first embodiment are denoted by the same reference signs. Particularly, the characteristic of the second embodiment is a method of inserting quiescent periods in the control signal for controlling the AC-pulse generation circuit 3. Therefore, only the control signals (1) and (2) required for the descriptions of this characteristic are illustrated.

In the first embodiment, the Ton and Toff periods are not changed in one ignition period. However, as illustrated in FIG. 3, it is possible that Toff is set shorter immediately after application of a DC voltage pulse, and is set longer as a time period that has passed since application of the DC voltage pulse increases. In this case, as the method of inserting quiescent periods is weighted, a minimum required AC pulse can be applied, and energy to be input can be reduced more appropriately.

In a group pulse, Toff is necessary for reduction of input power, and as Toff becomes longer, power reduction effect becomes larger. However, if Toff is too long, there is a possibility that a flame kernel cannot be formed. It is important to perform a discharge at a time and a space where a fuel drifts near a plug. A DC voltage pulse originally performs from generation of a discharge to forming of a flame kernel. That is, an application timing of the DC voltage pulse falls within a time period in which the fuel drifts near the plug. Accordingly, also regarding an AC pulse for supporting the DC voltage pulse, it is preferable that Toff is set shorter immediately after application of the DC voltage pulse to increase the density of application of the AC pulse. On the other hand, because the AC pulse is less necessary in a time period in which a flame kernel is growing, Toff is set longer.

Third Embodiment

Figure 4:
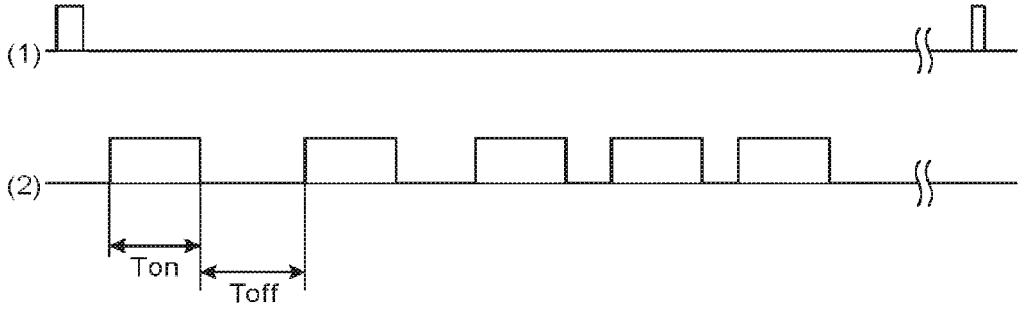
FIG. 4 is an explanatory diagram of operations of an ignition device of a spark-ignition internal combustion engine according to a third embodiment of the present invention.

FIG. 4 illustrates a part of operations of an ignition device of a spark-ignition internal combustion engine according to a third embodiment of the present invention. The circuit configuration of the ignition device according to the present embodiment can be identical to that of the first embodiment illustrated in FIG. 1. The present embodiment differs from the first embodiment in the group-pulse generating signal for generating group pulses and the control signal output from the control circuit 1 to control the AC-pulse generation circuit 3. FIG. 4 is a diagram illustrating control signals for driving the AC-pulse generation circuit 3 and the DC-voltage-pulse generation circuit 4 of the ignition device according to the present embodiment. In FIG. 4, signal names having the same function as that in the first embodiment are denoted by the same reference signs. Particularly, the characteristic of the third embodiment is a method of inserting quiescent periods in the control signal for controlling the AC-pulse generation circuit 3. Therefore, only the control signals (1) and (2) required for the descriptions of this characteristic are illustrated.

In the first embodiment, the Ton and Toff periods are not changed in one ignition period. However, as illustrated in FIG. 4, it is possible that Toff is set longer immediately after application of a DC voltage pulse, and is set shorter as a time period that has passed since application of the DC voltage pulse increases. In this case, as the method of inserting quiescent periods is weighted, a minimum required AC pulse can be applied, and energy to be input can be reduced more appropriately.

Insulation breakdown (discharge) caused by a DC voltage pulse involves considerable energy, and charged particles and heat generated by discharge become largest immediately after application of the DC voltage pulse, and they tend to decrease gradually. When the energy of the DC voltage pulse is sufficiently large, a flame kernel can be formed using only this energy. However, when the ignition device is used under a condition where ignition is difficult to perform, a formed flame kernel may dissipate or growth of a flame kernel may be slow. Immediately after application of the DC voltage pulse, an effect of the DC voltage pulse is synergistically provided so that the ignition performance is high even when Toff is set longer. However, when a certain time passes since application of the DC voltage pulse, ignition needs to be performed again only by an AC pulse or growth of the flame kernel needs to be facilitated. That is, it is preferable that Toff is set longer immediately after application of the DC voltage pulse and Toff is set shorter when some time has passed since application of the DC voltage pulse.

Whether Toff should be set longer immediately after application of a DC voltage pulse as in the third embodiment or Toff should be set longer as a time period that has passed since application of the DC voltage pulse increases as in the second embodiment depends on the operation environment of an engine, set energy of the DC voltage pulse, and the plug shape. This can be appropriately selected under respective environments.

Fourth Embodiment

Figure 5:
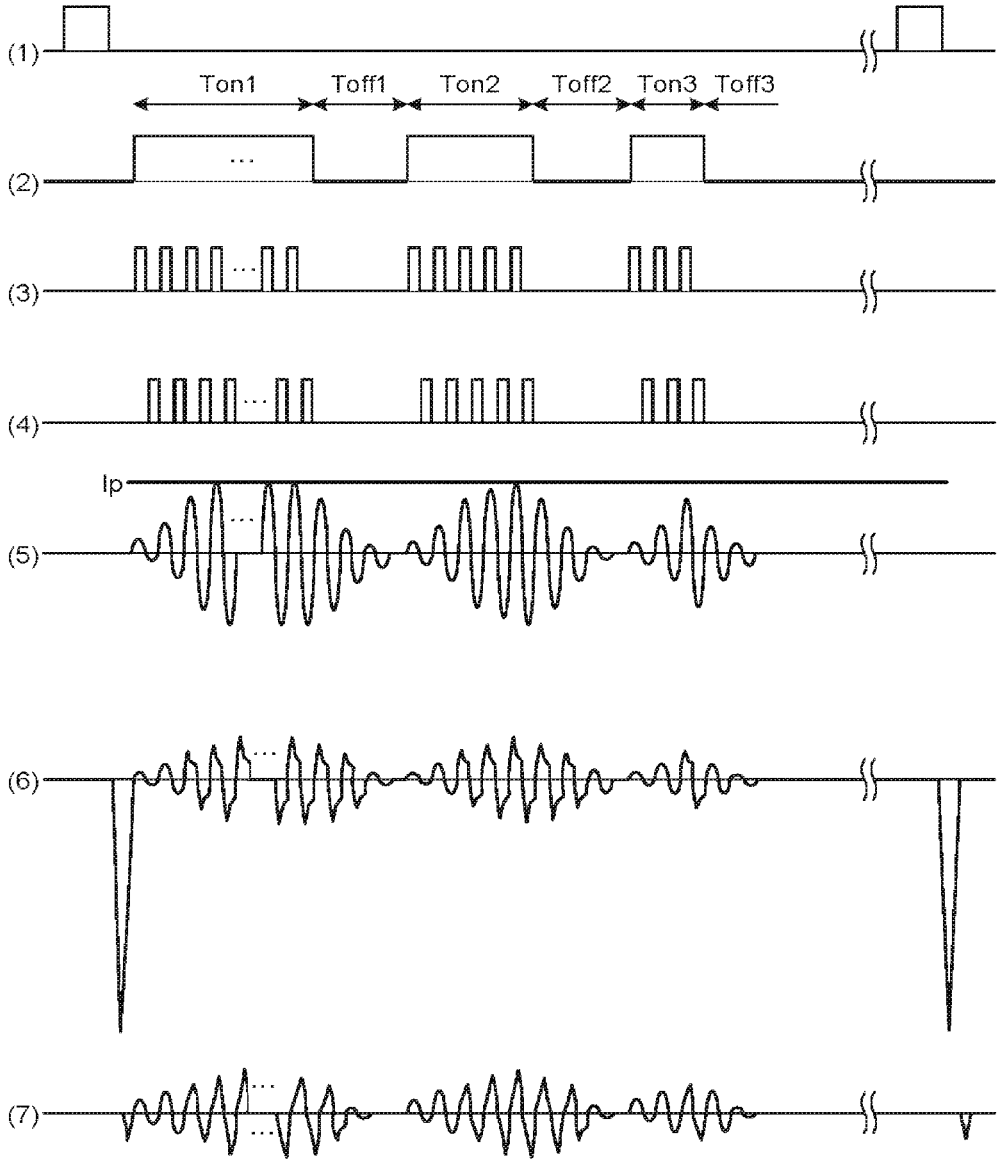
FIG. 5 is an explanatory diagram of operations of an ignition device of a spark-ignition internal combustion engine according to a fourth embodiment of the present invention.

FIG. 5 is an explanatory diagram of operations of the control circuit 1, the AC-pulse generation circuit 3, and the DC-voltage-pulse generation circuit 4 of an ignition device according to a fourth embodiment of the present invention. The circuit configuration of the ignition device according to the present embodiment can be identical to that of the first embodiment illustrated in FIG. 1. The present embodiment differs from the first embodiment in the group-pulse generating signal for generating group pulses and the control signal output from the control circuit 1 to control the AC-pulse generation circuit 3. In FIG. 5, signal names having the same function as that in the first embodiment are denoted by the same reference signs. Particularly, the characteristic of the fourth embodiment resides in the length of the Ton period in the control signal for controlling the AC-pulse generation circuit 3, and thus, in order to describe the relation between a change in Ton and a current peak value, in addition to the control signals (1) to (4), (5) to (7) indicating a current waveform and a voltage waveform are illustrated.

In the first embodiment, the Ton and Toff periods are not changed in one ignition period. However, as illustrated in FIG. 5, it is possible that Ton is set longer immediately after application of a DC voltage pulse, and is set shorter as a time period that has passed since application of the DC voltage pulse increases. In this case, the output from a high-frequency generation circuit can be intensified in a period in which it is needed and can be reduced in a period of lower importance. Therefore, efficient reduction in power can be achieved.

To make the current waveform enter a steady state, that is, to make the current peak value constant, Ton needs to be set longer than a time required for growth of discharge and a time required for growth of resonance. Conversely, when Ton is made shorter than these times, the current peak value can be lowered to adjust instantaneous input power. In the second embodiment or the third embodiment, it has been described that by inserting appropriate quiescent periods in the time intervals, energy can be reduced. On the other hand, the main point of the present embodiment is to reduce energy adjusting a current value to be input.

In FIG. 5, Ton1, Ton2, and Ton3 represent a first group pulse, a second group pulse, and a third group pulse, respectively. Quiescent periods Toff1, Toff2, and Toff3 are inserted between the respective group pulses. The group pulses are applied in 1 millisecond, for example. A current peak value of the current waveform (5) is Ip. Ton1 needs to be applied for a period in which growth of resonance and a flame kernel have been sufficiently achieved. In the present embodiment, for example, Ton1 is 70 microseconds. That is, in Ton1, a time in which the current peak value Ip is output is longer than the growth and attenuation times of resonance and a flame kernel. Ton2 is set shorter than Ton1. For example, when Ton2 is set to 10 microseconds, although the current peak value reaches Ip, a growth time to reach Ip or an attenuation time after Ton2 becomes off is longer. Furthermore, in Ton3, the output of the AC pulse is set to stop before the current peak value reaches Ip. For example, Ton3 is set to about 4 microseconds.

In the fourth embodiment, in the first group pulse Ton1 immediately after application of a DC voltage pulse, because the output from the DC-voltage-pulse generation circuit 4 is large and intensive discharge is generated at the spark plug 2, the ignition performance is high. This viewpoint is same as that described in the second embodiment. Because a time period in which fuel drifts near the spark plug 2 is originally immediately after insulation breakdown with the DC voltage pulse, the ignition performance here is enhanced. On the other hand, when a certain time passes since the DC voltage pulse (for example, in a period in which 500 microseconds to 1 millisecond has passed since the DC voltage pulse), as it is supposed that it is not necessary to intensify discharge too much, a group pulse whose form is similar to that of the third group pulse Ton3 may be applied.

Fifth Embodiment

Figure 6:
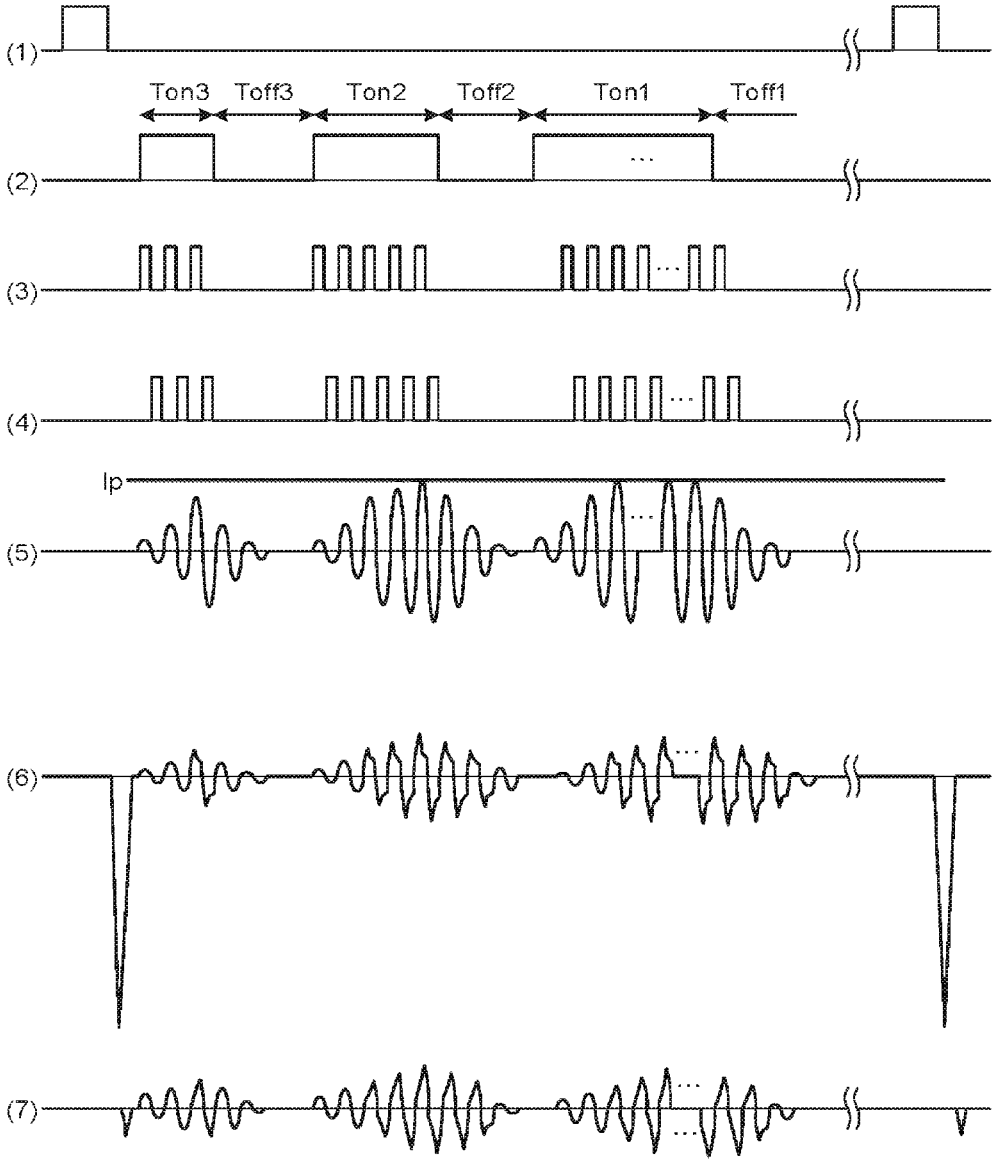
FIG. 6 is an explanatory diagram of operations of an ignition device of a spark-ignition internal combustion engine according to a fifth embodiment of the present invention.

FIG. 6 is an explanatory diagram of operations of the control circuit 1, the AC-pulse generation circuit 3, and the DC-voltage-pulse generation circuit 4 of an ignition device according to a fifth embodiment of the present invention. The circuit configuration of the ignition device according to the present embodiment can be identical to that of the first embodiment illustrated in FIG. 1. The present embodiment differs from the first embodiment in the group-pulse generating signal for generating group pulses and the control signal output from the control circuit 1 to control the AC-pulse generation circuit 3. In FIG. 6, signal names having the same function as that in the first embodiment are denoted by the same reference signs. Particularly, the characteristic of the fifth embodiment resides in the length of the Ton period in the control signal for controlling the AC-pulse generation circuit 3, and thus, in order to describe the relation between a change in Ton and a current peak value, in addition to the control signals (1) to (4), (5) to (7) indicating a current waveform and a voltage waveform are illustrated here.

In the first embodiment, the Ton and Toff periods are not changed in one ignition period. However, as illustrated in FIG. 6, it is possible that Ton is set shorter immediately after application of a DC voltage pulse, and is set longer as a time period that has passed since application of the DC voltage pulse increases. In this case, the output from a high-frequency generation circuit can be intensified in a period in which it is needed and can be reduced in a period of lower importance. Therefore, efficient reduction in power can be achieved.

Whether Ton should be set longer immediately after application of a DC voltage pulse as in the fourth embodiment or Ton should be set longer as a time period that has passed since application of the DC voltage pulse increases as in the fifth embodiment depends on the operation environment of an engine, set energy of the DC voltage pulse, and the plug shape. This can be appropriately selected for each environment.

The methods of controlling Toff as in the second embodiment and the third embodiment may be combined with the methods of controlling Ton as in the fourth embodiment and the fifth embodiment. It is possible that short Toff is inserted after long Ton, and long Toff is inserted after short Ton. On the other hand, it is possible that long Toff is inserted after long Ton, and short Toff is inserted after short Ton. Alternatively, in one ignition period, it is possible that first Ton and the last Ton are set longer, and further, Toff is set shorter, Ton in the middle is set shorter, and Toff is set shorter.

Sixth Embodiment

Figure 7:
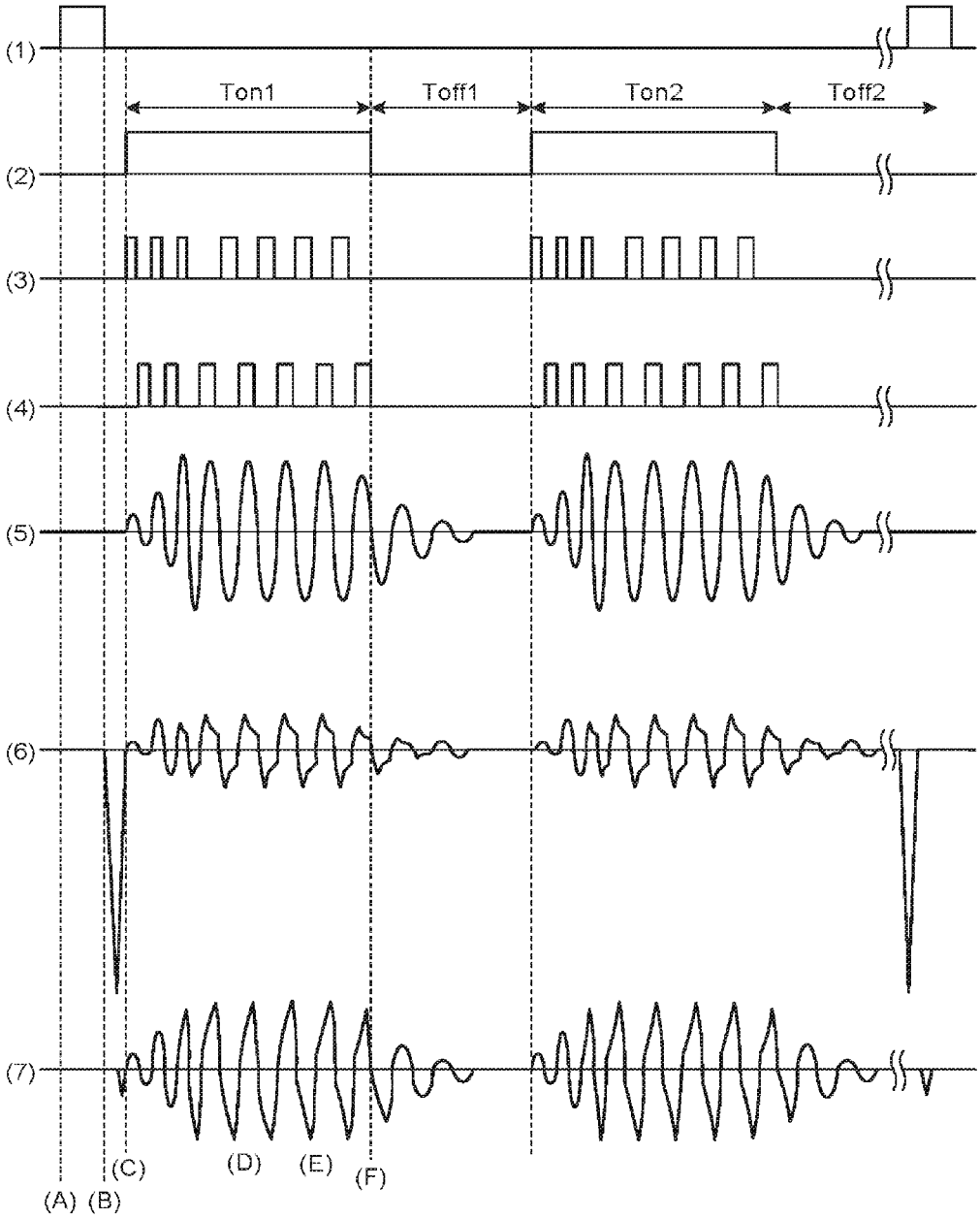
FIG. 7 is an explanatory diagram of operations of an ignition device of a spark-ignition internal combustion engine according to a sixth embodiment of the present invention.

FIG. 7 is an explanatory diagram of operations of the control circuit 1, the AC-pulse generation circuit 3, and the DC-voltage-pulse generation circuit 4 of an ignition device according to a sixth embodiment of the present invention. The sixth embodiment is described with reference to FIG. 7.

In the first to fifth embodiments, a fixed frequency is applied during the Ton period. On the other hand, in the present embodiment, a frequency in the Ton period is changed. The relation between Ton and Toff is that discharge grows in the Ton period while the discharge stops, so as to reduce power to be input to the plug in the Toff period. When Toff is long, discharge cannot be resumed in the next Ton period so that discharge disappears. That is, since it is important for discharge to grow sufficiently in the Ton period. Particularly at an early stage of the Ton period in which discharge is stopped, it is preferable to provide a mode in which a voltage abruptly rises.

Particularly, an impedance between electrodes in discharging differs from that in non-discharging, and it can be supposed that a resistance value in the Toff period is higher than that in the Ton period. That is, the impedance changes from moment to moment at the early stage of the Ton period, which is a transition state from a discharge stopped state to a discharge resuming state, although it is in the Ton period. That is, the resonance frequency at the early stage of the Ton period also differs from that just before the end of the Ton period in which the discharge has grown sufficiently.

Therefore, in the present embodiment, as illustrated in FIG. 7, the frequency at an early stage in each Ton (in FIG. 7, Ton1 and Ton2 are illustrated) is set high to correspond to the resonance frequency in a non-discharge state, and after a few cycles, a resonance frequency in each Ton is set to correspond substantially to the resonance frequency in the discharge state. Accordingly, at the early stage of application of each Ton, a voltage quickly rises in a gap between the electrodes, and discharge can be resumed promptly. In FIG. 7, specifically, in both Ton1 and Ton2, the frequency at the early stage of application is set high and subsequently becomes a fixed frequency. However, this setting is not always necessary. Considering the fact that Ton1, which is at an early stage of ignition, is in a discharge state, it is not necessary to set the frequency at the early stage of the application period high. In Ton2 that is subsequent to Toff1, the frequency can be set high only at the early stage of application of Ton2.

Furthermore, when a control method for automatically tracking the resonance frequency is combined, it is not necessary to set the frequency particularly to a fixed value, and when discharge is suspended, it is possible to execute control such that the application voltage increases as the frequency automatically increases.

In the present embodiment, power of group pulses required to start discharge is adjusted by changing the resonance frequency. Alternatively, the value of the DC power source 303 in FIG. 1 may be changed. The voltage of the DC power source 303 at the early stage of Ton may be set high and the voltage of the DC power source 303 just before the end of application of Ton after discharge has become stable may be set low.

According to the present embodiment, even when a quiescent period is provided between a group pulse and another group pulse, discharge can be resumed stably.

INDUSTRIAL APPLICABILITY

As described above, the present invention is useful as an ignition device of a spark-ignition internal combustion engine that performs ignition with high energy efficiency while reducing input power.

REFERENCE SIGNS LIST

1 control circuit, 2 spark plug, 3 AC-pulse generation circuit, 4 DC-voltage-pulse generation circuit, 5 reactor, 6 serial capacitor, 7 resonance capacitor, 31 switching unit, 32 resonance unit, 201 center electrode, 202 ground electrode, 301, 302, 401 switching element, 303 DC power source, 402 ignition coil.

The invention claimed is:

1. An ignition device of a spark-ignition internal combustion engine comprising:

a DC-voltage-pulse generation circuit to generate a DC voltage pulse between electrodes of a spark plug positioned in an internal combustion engine;

an AC-pulse generation circuit to generate an AC pulse between the electrodes of the spark plug; and a control circuit that controls such that the AC-pulse generation circuit operates after the DC-voltage-pulse generation circuit operates, and controls the AC-pulse generation circuit using a control signal having a plurality of group pulses, a quiescent period being provided between each of the group pulses in one ignition period, and setting the quiescent period longer as a time period that has passed since generation of the DC voltage pulse increases.

2. An ignition device of a spark-ignition internal combustion engine comprising:

a DC-voltage-pulse generation circuit to generate a DC voltage pulse between electrodes of a spark plug positioned in an internal combustion engine;

an AC-pulse generation circuit to generate an AC pulse between the electrodes of the spark plug, and a control circuit to control such that the AC-pulse generation circuit operates after the DC-voltage-pulse generation circuit operates, and control the AC-pulse generation circuit using a control signal having a plurality of group pulses, a quiescent period being provided between each of the group pulses in one ignition period, and setting the quiescent period shorter as a time period that has passed since generation of the DC voltage pulse increases.

3. The ignition device of a spark-ignition internal combustion engine according to claim 1, wherein the control circuit sets an output time of the group pulses longer as a time period that has passed since generation of the DC voltage pulse increases.

4. The ignition device of a spark-ignition internal combustion engine according to claim 1, wherein the control circuit sets an output time of the group pulses shorter as a time period that has passed since generation of the DC voltage pulse increases.

5. The ignition device of a spark-ignition internal combustion engine according to claim 1, wherein the control circuit sets a frequency of the AC-pulse generation circuit at an early stage of an application period of the group pulse higher than a frequency immediately before an end of the application period of the group pulse.

6. The ignition device of a spark-ignition internal combustion engine according to claim 1, wherein an output voltage of the AC-pulse generation circuit at an early stage of an application period of the group pulse is set higher than an output voltage immediately before an end of the application period of the group pulse.

7. The ignition device of a spark-ignition internal combustion engine according to claim 2, wherein the control circuit sets an output time of the group pulses longer as a time period that has passed since generation of the DC voltage pulse increases.

8. The ignition device of a spark-ignition internal combustion engine according to claim 2, wherein the control circuit sets an output time of the group pulses shorter as a time period that has passed since generation of the DC voltage pulse increases.

9. The ignition device of a spark-ignition internal combustion engine according to claim 2, wherein the control circuit sets a frequency of the AC-pulse generation circuit at an early stage of an application period of the group pulse higher than the frequency immediately before an end of the application period of the group pulse.

10. The ignition device of a spark-ignition internal combustion engine according to claim 2, wherein an output voltage of the AC-pulse generation circuit at an early stage of an application period of the group pulse is set higher than an output voltage immediately before an end of the application period of the group pulse.

11. An ignition device of a spark-ignition internal combustion engine comprising:

a DC-voltage-pulse generation circuit to generate a DC voltage pulse between electrodes of a spark plug positioned in an internal combustion engine;

an AC-pulse generation circuit that includes a reactor connected to the spark plug in series and a capacitor connected to the reactor and the spark plug in series, and is connected to the spark plug and the DC-voltage-pulse generation circuit in parallel; and a control circuit to control such that the AC-pulse generation circuit outputs AC pulses as a plurality of group pulses from the AC-pulse generation circuit after outputting a DC voltage pulse from the DC-voltage-pulse generation circuit in one ignition period.

12. The ignition device of a spark-ignition internal combustion engine according to claim 11, wherein the control circuit sets an output time of the group pulses longer as a time period that has passed since generation of the DC voltage pulse increases.

13. The ignition device of a spark-ignition internal combustion engine according to claim 11, wherein the control circuit sets an output time of the group pulses shorter as a time period that has passed since generation of the DC voltage pulse increases.

14. The ignition device of a spark-ignition internal combustion engine according to claim 11, wherein the control circuit sets a frequency of the AC-pulse generation circuit at an early stage of an application period of the group pulse higher than the frequency immediately before an end of the application period of the group pulse.

15. The ignition device of a spark-ignition internal combustion engine according to claim 11, wherein an output voltage of the AC-pulse generation circuit at an early stage of an application period of the group pulse is set higher than an output voltage immediately before an end of the application period of the group pulse.

* * * * *